US010369811B2

(12) United States Patent
Chang

(10) Patent No.: US 10,369,811 B2
(45) Date of Patent: Aug. 6, 2019

(54) PRINTING METHOD FOR APPAREL FABRIC

(71) Applicant: TsingHua (Suzhou) Technical Research Center, Suzhou (CN)

(72) Inventor: Shan Chang, Suzhou (CN)

(73) Assignee: TSINGHUA (SUZHOU) TECHNICAL RESEARCH CENTER, Suzhou (CN)

( * ) Notice: Subject to any disclaimer, the term of this patent is extended or adjusted under 35 U.S.C. 154(b) by 0 days.

(21) Appl. No.: 16/029,448

(22) Filed: Jul. 6, 2018

(65) Prior Publication Data

US 2019/0134997 A1 May 9, 2019

(30) Foreign Application Priority Data

Nov. 3, 2017 (CN) ..... 2017 1 1070121

(51) Int. Cl.

| | |
|---|---|
| ***B41J 11/00*** | (2006.01) |
| ***B41J 3/407*** | (2006.01) |
| ***B41M 7/00*** | (2006.01) |

(52) U.S. Cl.

CPC ..... *B41J 11/0015* (2013.01); *B41J 3/4078* (2013.01); *B41J 11/002* (2013.01); *B41M 7/009* (2013.01)

(58) Field of Classification Search

CPC .... B41J 11/0015; B41J 3/4078; B41J 11/002; B41M 7/009

See application file for complete search history.

(56) References Cited

U.S. PATENT DOCUMENTS 5,795,425 A * 8/1998 Brault ..... B41M 5/0256 156/235

* cited by examiner

*Primary Examiner* — Bradley W Thies
(74) *Attorney, Agent, or Firm* — Seed IP Law Group LLP

(57) ABSTRACT

Disclosed in the present invention is a printing method for apparel fabric, comprising the steps of: (1) thermal compounding: stacking and placing the apparel fabric and thermal adhesive printing paper into a first heating device set to a first preset temperature, wherein a surface of the thermal adhesive printing paper is provided with a thermal adhesive, and the thermal adhesive is heated to compound the apparel fabric and the thermal adhesive printing paper together to form a compounded paper/apparel fabric roll; (2) printing: loading the compounded paper/apparel fabric roll onto a printer, and printing graphics and text on the apparel fabric of the compounded paper/apparel fabric roll to form a printed cloth; (3) thermal fixation: fixing the color of the printed cloth through a second heating device set to a second preset temperature for a preset time.

10 Claims, 2 Drawing Sheets

PRINTING METHOD FOR APPAREL FABRIC

TECHNICAL FIELD

The present invention relates to a printing method for apparel fabric where inkjet printing is performed after the apparel fabric is compounded with paper, which belongs to the field of textile printing and dyeing.

BACKGROUND

Common textile printing methods include a dye ink inkjet method, a pigment ink inkjet method, an inkjet transfer printing method and the like.

Dye ink inkjet method: aqueous slurry is first applied on the apparel fabric, and dried and pasted on a guide band printer coated with an adhesive sticker; graphics and text are printed with active or acid dye inks, then steaming and color development are performed; and after many times of washing and subsequent drying, printing is completed. The process of the method is roughly as follows: coating-drying-guide band machine printing-drying-steaming-washing for multiple times-drying-shaping and sewage treatment. Disadvantages of this method include: 1. The flaw generated before printing directly becomes a printing flaw, and the qualification rate is low; 2. the process flow of printing is long and the energy consumption is high; 3. the paste on the apparel fabric is a water-soluble glue, and after inkjet printing, the paste will be washed together with the excess ink, causing sewage that is difficult to treat.

Pigment ink inkjet method: a pre-treatment agent is applied on the apparel fabric, and dried and pasted on a guide band printer applied with an adhesive sticker; graphics and text are printed with a pigment ink; then a post-treatment agent is coated on the printed apparel fabric, and dried and fixed by a drying tunnel to complete printing. The process flow is roughly as follows: coating a pre-treatment agent using a sizing machine-drying-printing using a guide band machine-coating a post-treatment agent using the sizing machine-drying-fixing the color using a drying tunnel. Disadvantages of this method include: 1. the flaw generating during pre-treatment directly becomes a printing flaw, and the qualification rate is low; 2. because the treatment agents are applied on the apparel fabric twice, the cost is higher; 3. the hand feeling of the printed cloth becomes stiff and the color becomes lighter.

Inkjet transfer printing method: disperse dye ink and dye-sublimation transfer paper are loaded onto a printer; graphics and text are printed on the dye-sublimation transfer paper; then the printed surface of the paper is attached to the apparel fabric and then transferred to a heat transfer machine for sublimation transfer at a temperature of about 200° C.; the disperse dyes are vaporized into the polyester fibers, and the transfer paper is torn off to complete printing. The process of this method is roughly as follows: inkjet-printing transfer paper—performing thermal transfer—obtaining a printed product. The main disadvantage of this method is: because the sublimation temperature of the dye cannot match the temperature of most fibers, it can only be used for the printing of polyester fiber fabrics, and cannot be printed on natural fibers, mixed fibers and other fabrics.

SUMMARY

The object of the present invention is to provide a printing method for apparel fabric. The printing method for apparel fabric has a simple procedure and is suitable for a variety of fabrics.

To achieve the above object of the present invention, the present invention provides a printing method for apparel fabric. The printing method includes the steps of:

(1) thermal compounding: stacking and placing the apparel fabric and thermal adhesive printing paper into a first heating device set to a first preset temperature, wherein a surface of the thermal adhesive printing paper is provided with a thermal adhesive, and the thermal adhesive is heated to compound the apparel fabric and the thermal adhesive printing paper together to form a compounded paper/apparel fabric roll;

(2) printing: loading the compounded paper/apparel fabric roll onto a printer, and printing graphics and text on the apparel fabric of the compounded paper/apparel fabric roll to form a printed cloth; and (3) thermal fixation: fixing the color of the printed cloth through a second heating device set to a second preset temperature for a preset time.

As an improvement of an embodiment of the present invention, the surface of the thermal adhesive printing paper is further provided with a printing additive, and during the "thermal compounding" process, the printing additive is heated and penetrates into the fibers of the apparel fabric.

As a further improvement of an embodiment of the present invention, the first heating device and the second heating device are the same one device.

As a further improvement of an embodiment of the present invention, the second heating device is a heating device that adopts a solid heat transfer method.

As a further improvement of an embodiment of the present invention, the second heating device is a hot roller or a hot plate.

As a further improvement of an embodiment of the present invention, the preset time required for the "thermal fixation" step is less than 2 minutes for different apparel fabrics.

As a further improvement of an embodiment of the present invention, the first preset temperature ranges from 95 to 150° C. for different apparel fabrics.

As a further improvement of an embodiment of the present invention, the second preset temperature ranges between 120-180° C. for different apparel fabrics.

As a further improvement of an embodiment of the present invention, the printer is a inkjet printer without guide band.

As a further improvement of an embodiment of the present invention, the printer uses coating ink or solvent ink for different apparel fabrics.

As a further improvement of an embodiment of the present invention, the printing method for apparel fabric further includes the step of (4) separating: separating the apparel fabric from the thermal adhesive printing paper.

As a further improvement of an embodiment of the present invention, in the "separation" step, a paper/cloth separation roller is used to separate the apparel fabric from the thermal adhesive printing paper.

Compared with the prior art, the beneficial effect of the present invention lies in the followings: the printing method of the present invention completes the printing of apparel fabrics through three steps of "thermal compounding-printing-thermal fixation", so that the printing equipment of apparel fabrics and operation are simplified, and the printing cost is reduced; the present invention is suitable for the printing of various fabrics, the printing qualification rate of the apparel fabric is improved, and the hand feeling of printed cloths is improved. Therefore, the present invention is of great promotional value.

Figure 1:
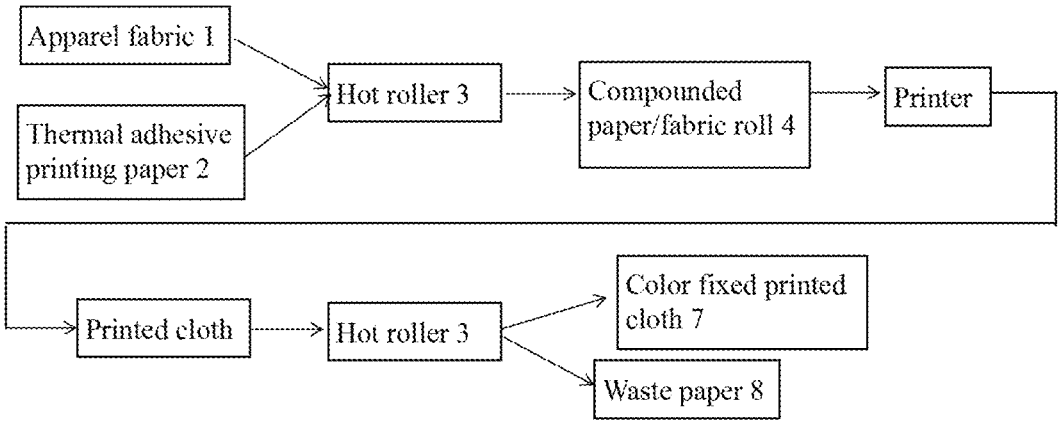
FIG. 1 is a flow block diagram of a printing method for apparel fabric according to a specific embodiment of the present invention.

Hereinafter, some specific embodiments of the present invention will be described in detail by way of examples and not by way of limitation with reference to the accompanying drawings. The same reference numbers in the drawings denote the same or similar parts or portions. Those skilled in the art should understand that these drawings are not necessarily drawn to scale.

DETAILED DESCRIPTION

The present invention will be described in detail below with reference to specific embodiments shown in the accompanying drawings. However, these embodiments do not limit the present invention, and structural, methodological, or functional changes made by those skilled in the art based on these embodiments are all included in the scope of the present invention.

It should be understood that, in the description of the present invention, the terms "first", "second", and the like are used for descriptive purposes only, but cannot be interpreted as indicating or implying relative importance or implying the number of indicated technical features. Thus, features defined as "first", "second" may explicitly or implicitly include one or more of the features.

In this description, the printing method for apparel fabric is first introduced as a whole, and the printing method is specifically described for different fabrics.

The following provides a general introduction to the printing method for apparel fabric according to the present invention.

Figure 3:
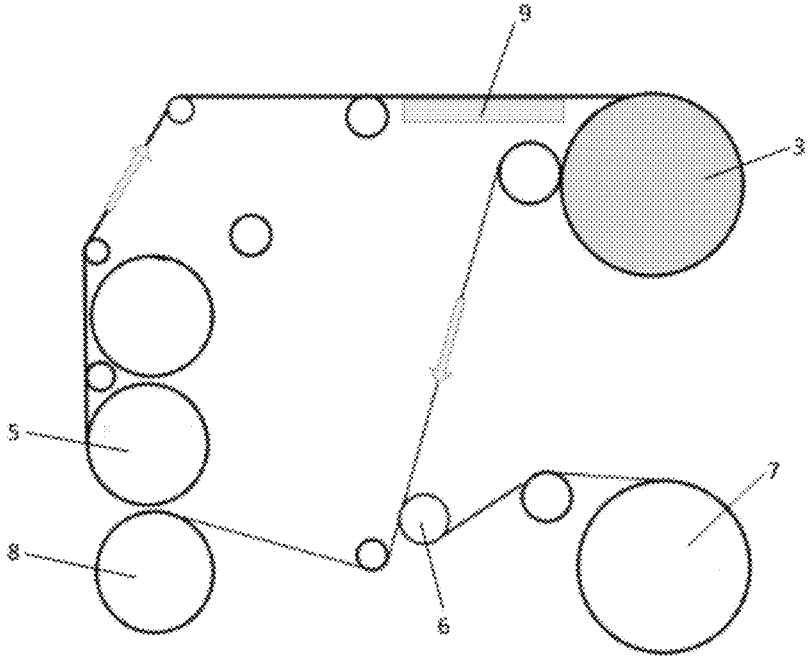
FIG. 3 is a schematic diagram of "thermal fixation" of the printing method for apparel fabric shown in FIG. 1.

With reference to FIG. 1 and FIG. 3, a printing method for apparel fabric according to an embodiment of the present invention includes the following steps.

Figure 2:
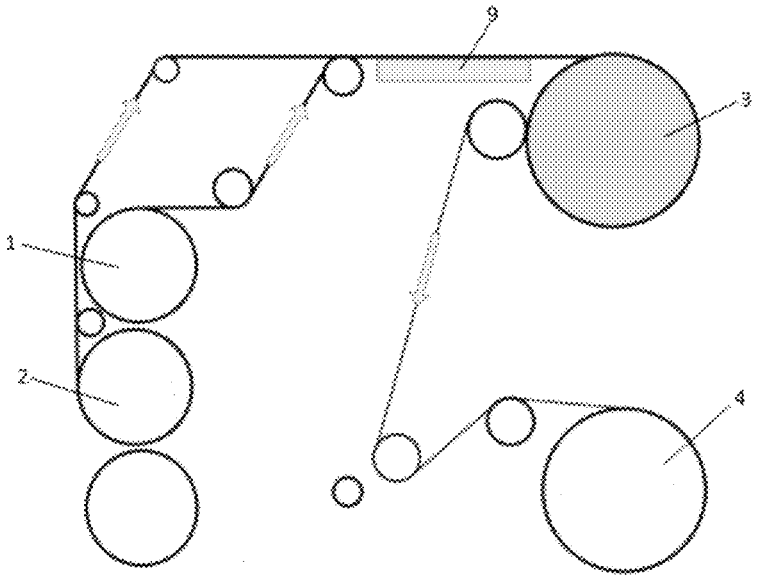
FIG. 2 is a schematic view of "thermal compounding" of the printing method for apparel fabric shown in FIG. 1.

(1) Thermal compounding (referring to FIG. 1 and FIG. 2): apparel fabric 2 and thermal adhesive printing paper 1 are stacked and placed into a first heating device set to a first preset temperature, a surface of the thermal adhesive printing paper 1 is provided with a thermal adhesive which is heated to compound the apparel fabric 2 and the thermal adhesive printing paper 1 together to form a compounded paper/fabric roll 4.

(2) Printing (not shown in the figure): the compounded paper/fabric roll 4 is loaded into a printer, and graphics and text are printed on the apparel fabric 2 of the compounded paper/fabric roll 4 to form a printed cloth 5.

(3) Thermal fixation (referring to FIG. 1 and FIG. 3): the color of the printed cloth 5 is fixed through a second heating device set to a second preset temperature for a preset time.

Since the apparel fabric 2 is usually soft and difficult to be directly loaded into the printer, the printing method of the present embodiment compounds the apparel fabric 2 and the thermal adhesive printing paper 1 together in the "thermal compounding" step to obtain the compounded paper/fabric roll which can be loaded into the printer 4 conveniently. The printing of the compounded paper/fabric roll 4 does not require expensive dedicated guide band printers and only requires an ordinary printer, which can greatly reduce equipment investment. In the printing step, as the graphics and text are directly printed on the apparel fabric 2, this step can be applied to the printing of various fabrics. In addition, the printing method of the present embodiment omits the application of treatment agents before and after inkjet printing, which not only greatly improves the printing qualification rate of the apparel fabric 2, but also avoids stiff hand feeling of the printed apparel fabric 2.

In summary, the printing method of the present embodiment completes the printing of the apparel fabric 2 through three steps of "thermal compounding-printing-thermal fixation", so that the printing equipment of the apparel fabric 2 and operation are simplified, the printing cost is reduced. The present embodiment is applicable to the printing of a variety of fabrics. The printing qualification rate of the apparel fabric 2 is improved, and the feel of the printed cloth is improved. Therefore, the promotional value of the present invention is high.

In this embodiment, preferably, the surface of the thermal adhesive printing paper 1 is further provided with a printing additive. During the "thermal compounding" process, the printing additive is heated and penetrates into the fibers of the apparel fabric 2.

This embodiment smartly utilizes the "thermal compounding" step in which the apparel fabric 2 and the thermal adhesive printing paper 1 are compounded so that the printing additive penetrates into the apparel fabric 2, greatly improving the printing quality without increasing the printing step, which has a reasonable process and smart design.

Preferably, according to the embodiment, the first heating device and the second heating device are the same one device.

In other words, the same heating device is used in "thermal compounding" and "thermal fixation" to simplify the printing equipment. Moreover, since the same heating device is used in "thermal compounding" and "thermal fixation", "thermal compounding" and "thermal fixation" can be completed on the same short production line, thereby simplifying the equipment, and reducing the dimensions of the equipment as well as the investment cost.

In this embodiment, preferably, the second heating device is a heating device adopting a solid heat transfer method.

The traditional drying tunnel adopts air heat-transfer for fixation, and the fixation process needs 5-6 minutes. The second heating device for "thermal fixation" of this embodiment adopts a solid heat transfer method, which can reduce the equipment dimensions. Also in the present embodiment, for different apparel fabrics 2, the time required for the "thermal fixation" step is less than 1 minute, which can greatly shorten the fixation time and increase the production efficiency.

In the present embodiment, preferably, the second heating device is a hot roller 3 or a hot plate.

The heat roller 3 can be realized by an inexpensive heat roller transfer machine commonly used in a general digital printing factory. Therefore, the equipment investment, machine dimensions, and operation cost of the present invention are relatively low compared to conventional technologies.

The hot flat plate has a relatively simple operation procedure and a high thermal efficiency for the apparel fabric 2 having a relatively small area.

In the present embodiment, preferably, for different apparel fabrics 2, the first preset temperature in the "thermal fixation" step ranges from 95-150° C.

Since the thermal adhesive printing paper 1 is sticky at the temperature of 95-150° C. and can bond the apparel fabric 2, it is convenient to form the compounded paper/fabric roll 4 that can be conveniently loaded into the printer.

In this embodiment, preferably, for different apparel fabrics 2, the second preset temperature in the "thermal fixation" step ranges between 120 and 180° C. It is suitable for the fixation of various kinds of fabrics and has high efficiency.

In the present embodiment, preferably, the printer is an inkjet printer without guide band. As a result, the printing method of the present embodiment does not require an expensive dedicated guide band printer, but only an ordinary printer, which can greatly reduce the investment in equipment.

In this embodiment, it is preferable that the printer uses a coating ink or a solvent ink for different apparel fabrics 2. The printing quality is high and the cost is low.

In this embodiment, preferably, the printing method for apparel fabric 2 further includes the step of (4) separating: the apparel fabric 2 of the fixed printed cloth 7 is separated from the thermal adhesive printing paper 1. In the present embodiment, preferably, in the "separating" step, a paper/cloth separation roller 6 is used to separate the fixed printed cloth 7 from the thermal adhesive printing paper 1. The separated waste paper 8 can be reused to protect the environment. It is conceivable to those skilled in the art that it is also possible to manually separate the apparel fabric 2 from the thermal adhesive printing paper 1. Any scheme that is the same as or similar to the embodiment is covered by the protection scope of the present invention.

Referring to FIG. 1 and FIG. 3, the printing method will be described in the following specifically for different fabrics.

Embodiment 1: Inkjet Printing on Linen Cloth (1) A white linen cloth is placed on the thermal adhesive printing paper 1 and enters the surface of the hot roller 3 set to a temperature of 150 degrees to obtain a compounded paper/linen roll.

(2) The compounded paper/linen roll is loaded into an inkjet printer loaded with a coating ink, and then graphics and text are inkjet-printed on the cloth surface of the compounded paper/linen roll to obtain a printed cloth.

(3) The color of the roll printed cloth 5 is fixed through the heat roller 3 set to a temperature of 150° C. for about 0.5 minute; the paper and cloth are separated at the paper/cloth separation roller 6; the waste paper 8 is rolled up and reused; and the fixed linen cloth is rolled up as a finished printed linen cloth.

Embodiment 2: Inkjet Printing on Knitted Elastic Cotton Cloth (1) A knitted elastic cotton cloth is placed on the thermal adhesive printing paper 1 and enters the surface of the heat roller 3 set to a temperature of 120 degrees to obtain a compounded paper/knitted elastic cotton cloth roll.

(2) The compounded paper/knitted elastic cotton cloth roll is loaded into an inkjet printer loaded with a coating ink, and then graphics and text are inkjet printed on the cloth surface of the compounded paper/knit elastic cotton cloth roll to obtain a printed cloth.

(3) The color of the roll printed cloth 5 is fixed through the heat roller 3 set to 160° C. for about 2 minutes; the paper and cloth are separated at the paper/cloth separation roller 6; the waste paper 8 is rolled up and reused; and the fixed knitted elastic cotton cloth is rolled up as a finished printed cloth.

Embodiment 3: Inkjet Printing on Nylon Cloth (1) A nylon cloth is placed on the thermal adhesive printing paper 1 and enters the surface of the heat roller 3 set to a temperature of 130 degrees to obtain a compounded paper/nylon cloth roll.

(2) The compounded paper/nylon cloth roll is loaded into an inkjet printer loaded with a coating ink, and graphics and text are then inkjet printed on the cloth surface of the compounded paper/nylon cloth roll to obtain a printed cloth.

(3) The color of the roll printed cloth 5 is fixed through the heat roller 3 set to 140° C. for about 0.7 minute; the paper and cloth are separated at the paper/cloth separation roller 6; the waste paper 8 is rolled up and reused; and the fixed nylon cloth is rolled up as a finished printed cloth.

Embodiment 4: Inkjet Printing on Polyester-Cotton Blended Cloth (1) A polyester-cotton blended cloth is placed on the thermal adhesive printing paper 1 and enters the surface of the hot roller 3 set to a temperature of 150 degrees to obtain a compounded paper/polyester-cotton blended cloth roll.

(2) The compounded paper/polyester-cotton blended cloth roll is loaded into an inkjet printer loaded with coating ink, and graphics and text are then inkjet printed on the cloth surface of the compounded paper/polyester-cotton blended cloth roll to obtain a printed cloth.

(3) The color of the roll printed cloth 5 is fixed through the heat roller 3 set to 170° C. for about 0.5 minute; the paper and cloth are separated at the paper/cloth separation roller 6; the waste paper 8 is rolled up and reused; and the fixed polyester-cotton blended cloth is rolled up as a finished printed cloth.

Embodiment 5: Inkjet Printing on Cut Piece (1) A cut piece cloth is placed on the thermal adhesive printing paper 1 on an operation platform 9 and enters the surface of the hot roller 3 set to a temperature of 130 degrees to obtain a compounded paper/cut piece roll.

(2) The compounded paper/cut piece cloth roll is loaded into an inkjet printer loaded with coating ink, and then graphics and text are inkjet printed on the cloth surface of the compounded paper/cut piece cloth roll to obtain a printed cloth paper roll.

(3) The color of the printed cloth paper roll 5 is fixed through the heat roller 3 set to 160° C. for about 0.5 minute, and the thermal printing paper is peeled from the printed cut piece on the fixed cut piece cloth roll as a finished printed cloth.

Embodiment 6: Inkjet Printing on Sheet-Like Leather (1) Sheet-like leather is placed on the thermal adhesive printing paper 1 on the operation platform 9 and enters the surface of the hot roller 3 set to a temperature of 100 degrees to obtain a compounded paper/sheet-like leather roll.

(2) The compounded paper/sheet leather roll is loaded into an inkjet printer loaded with coating ink or a solvent ink, and then graphics and text are printed on the leather side of the compounded paper/sheet-like leather roll to obtain a printed sheet-like leather/paper roll.

(3) The color of the printed sheet-like leather/paper roll is fixed through the hot roller 3 or hot plate set to a temperature of 120° C. for about 30-50 seconds, and the thermal printing paper 1 is peeled from the sheet-like leather on the fixed sheet-like leather/paper to obtain finished sheet-like leather.

Again, the beneficial effects of the printing method of the present invention are emphasized as below.

(1) The process is simple and the equipment investment is low: the technical solution of the present invention simplifies the coating ink inkjet printing process, and does not require sizing and drying of apparel fabrics with a sizing machine or a coating machine before and after inkjet printing; the printing of the compounded paper cloth roll does not require an expensive dedicated guide band printer, but only requires an ordinary printer; there is no need to adopt a dedicated drying tunnel for fixation after printing; and the "thermal compounding" and the "thermal fixation" steps of the present invention can use the same heating device, preferably a heat roller; the hot roller can be realized by an inexpensive hot roll transfer machine commonly used in a general digital printing plant. Therefore, the present invention does not require an expensive special coating ink inkjet printing equipment (referring to a sizing machine, a guide band printer, or a fixation-specific drying tunnel machine). Instead, an ordinary inkjet printer and a set of heating equipment (for example, a hot roller) can be used to complete the coating ink inkjet printing of various apparel fabrics. The equipment investment, footprint and operating costs are relatively low compared to traditional technologies.

A set of traditional economical coating ink inkjet printing equipment costs more than RMB 1 million, while the device of the present invention only cost RMB 200,000. A set of ordinary coating ink inkjet printing equipment covers an area of 150 square meters or more, while the system of the present invention only covers an area of 25 square meters.

(2) Since the present invention omits the application of the treatment agents before and after inkjet printing, the printed apparel fabric does not have an additional stiff feel; another advantage of omitting the application of the treatment agents before and after inkjet printing is that the printing qualification rate of the apparel fabric is greatly improved; and yet another advantage of omitting the application of the treatment liquid before and after inkjet printing is to greatly reduce the printing costs of the apparel fabrics.

It should be understood that although the description is described in terms of embodiments, not every embodiment includes only a single technical solution. Such a narration of the specification is merely for the sake of clarity, and those skilled in the art should regard the description as a whole. The technical solutions in the embodiments may also be appropriately combined to form other embodiments that can be understood by those skilled in the art.

The series of detailed descriptions listed above are merely specific illustrations of feasible embodiments of the present invention, and they are not intended to limit the scope of the present invention. Equivalent embodiments or changes made within the technical spirit of the present invention should be included in the protection scope of the present invention.

What is claimed is:

1. A printing method for apparel fabric, comprising the steps of:

(1) thermal compounding: stacking and placing the apparel fabric and thermal adhesive printing paper into a first heating device set to a first preset temperature, wherein a surface of the thermal adhesive printing paper is provided with a thermal adhesive, and the thermal adhesive is heated to compound the apparel fabric and the thermal adhesive printing paper together to form a compounded paper/apparel fabric roll;

(2) printing: loading the compounded paper/apparel fabric roll onto a printer, and printing graphics and text on the apparel fabric of the compounded paper/apparel fabric roll to form a printed cloth; and (3) thermal fixation: fixing the color of the printed cloth through a second heating device set to a second preset temperature for a preset time.

2. The printing method for apparel fabric according to claim 1, wherein the surface of the thermal adhesive printing paper is further provided with a printing additive, and during the "thermal compounding" process, the printing additive is heated and penetrates into the fibers of the apparel fabric.

3. The printing method for apparel fabric according to claim 1, wherein the first heating device and the second heating device are the same one device.

4. The printing method for apparel fabric according to claim 1, wherein the second heating device is a heating device that adopts a solid heat transfer method.

5. The printing method for apparel fabric according to claim 4, wherein the second heating device is a hot roller or a hot plate.

6. The printing method for apparel fabric according to claim 1, wherein the first preset temperature ranges from 95 to 150° C. for different apparel fabrics.

7. The printing method for apparel fabric according to claim 1, wherein the second preset temperature ranges from 120 to 180° C. for different apparel fabrics.

8. The printing method for apparel fabric according to claim 1, wherein the printer is an inkjet printer without guide band.

9. The printing method for apparel fabric according to claim 1, wherein the printer uses coating ink or solvent ink for different apparel fabrics.

10. The printing method for apparel fabric according to claim 1, further comprising the step of (4) separating: separating the apparel fabric from the thermal adhesive printing paper.

* * * * *